United States Patent [19]

Marzoli et al.

[11] Patent Number: 5,018,245

[45] Date of Patent: May 28, 1991

[54] APPARATUS FOR OPENING AND MIXING STAPLE COTTON

[76] Inventors: Pietro B. Marzoli; Emilio Vezzoli, both of via Durante, 1, Palazzolo Sull'Oglio (BS), Italy

[21] Appl. No.: 425,414

[22] Filed: Oct. 23, 1989

[30] Foreign Application Priority Data

Jun. 1, 1989 [IT] Italy ..... 20723 A/89

[51] Int. Cl.[5] ..... D01G 13/00

[52] U.S. Cl. ..... 19/145.5; 19/200

[58] Field of Search ..... 19/145.5, 200, 105, 19/80 R, 202

[56] References Cited

U.S. PATENT DOCUMENTS

| | | | |
|---|---|---|---|
| 3,355,776 | 12/1967 | Reddick | 19/303 |
| 3,963,111 | 6/1976 | Harrell et al. | 19/105 |
| 4,045,091 | 8/1977 | Beneke | 19/105 |
| 4,154,485 | 5/1979 | Lytton et al. | 19/105 |
| 4,240,180 | 12/1980 | Wood et al. | 19/105 |
| 4,397,065 | 8/1983 | Bettomi et al. | 19/105 |
| 4,404,710 | 9/1983 | Wood | 19/105 |
| 4,520,530 | 6/1985 | Pinto | 19/105 |
| 4,531,262 | 7/1985 | Reiche | 19/105 |
| 4,797,979 | 1/1989 | Stäheli et al. | 19/105 |
| 4,858,277 | 8/1989 | Pinto et al | 19/105 |

FOREIGN PATENT DOCUMENTS

| | | | |
|---|---|---|---|
| 3336517 | 10/1983 | Fed. Rep. of Germany | 19/105 |
| 3705148 | 9/1988 | Fed. Rep. of Germany | 19/105 |
| 119461 | 8/1958 | U.S.S.R. | 19/105 |
| 292521 | 7/1969 | U.S.S.R. | 19/105 |
| 560014 | 6/1973 | U.S.S.R. | 19/353 |
| 1178835 | 1/1970 | United Kingdom | 19/352 |

*Primary Examiner*—W. C. Reynolds
*Assistant Examiner*—John J. Calvert
*Attorney, Agent, or Firm*—Bucknam and Archer

[57] ABSTRACT

An apparatus for opening and mixing staple cotton comprises two cotton supply chambers, having parallel vertical axes, at the bottom of each chamber being provided a first and a second opposite cooperating cylinders for gripping the cotton staples, and supplying the gripped staples to a respective cotton carding plate and cleaning blade.

2 Claims, 1 Drawing Sheet

APPARATUS FOR OPENING AND MIXING STAPLE COTTON

BACKGROUND OF THE INVENTION

The present invention relates to an apparatus for opening and mixing staple fibre cotton.

As is known, cotton is usually processed by an opening step, carried out by suitable openers, which operate to "open" the cotton fibres and remove therefrom possible impurities.

Known presently available openers, however, have a comparatively low efficiency, since they usually comprises a single cotton supply chamber.

Moreover, in conventional openers, the staple fibres are usually processed by one or more series arranged reels: with such a reel arrangement, in particular, it is possible to open and clean exclusively a cotton amount related to the loading volume of the single supply chamber.

Another drawback of conventional openers is that they disadvantageously pull and stretch the staple fibres being processed, with a poor mixing of the cotton staples.

SUMMARY OF THE INVENTION

The present invention sets out to overcome the above mentioned drawbacks, by providing an apparatus for opening and mixing staple cotton which is adapted for perfectly cleaning the cotton staples.

Within the scope of the above mentioned aim a main object of the present invention is to provide such an apparatus which perfectly homogenizes and mixes the fibre material.

Another object of the invention is to provide such an apparatus which does not subject the staple cotton to excessive pulling and stretching stresses.

According to one aspect of the present invention, the above mentioned objects, as well as yet other objects, which will become more apparent hereinafter, are achieved by an apparatus for opening and mixing staple cotton, characterized in that said apparatus comprises at least two vertical axis staple cotton supply chambers, at the bottom of each said chamber there being provided a staple cotton gripping cylinder and a staple cotton opening cylinder, near said opening cylinder there being moreover arranged devices for removing not spinnable cotton fibres, and a carding plate, means being also provided for alternately filling with staple cotton said chambers.

BRIEF DESCRIPTION OF THE DRAWINGS

Further characteristics and advantages of the present invention will become more apparent from the following detailed description of a preferred embodiment thereof, which is illustrated, by way of an indicative but not limitative example in the figures of the accompany drawings, where.

DESCRIPTION OF THE PREFERRED EMBODIMENT

With reference to the figures of the drawings, the apparatus for opening and mixing staple cotton according to the present invention comprises at least two adjoining vertical chambers 1 and 1' which are alternately supplied, by the conveyor 2 and counter-rotating cylinders 3, with staple cotton material conveyed through the duct 4 by a negative pressure.

Figure 1:
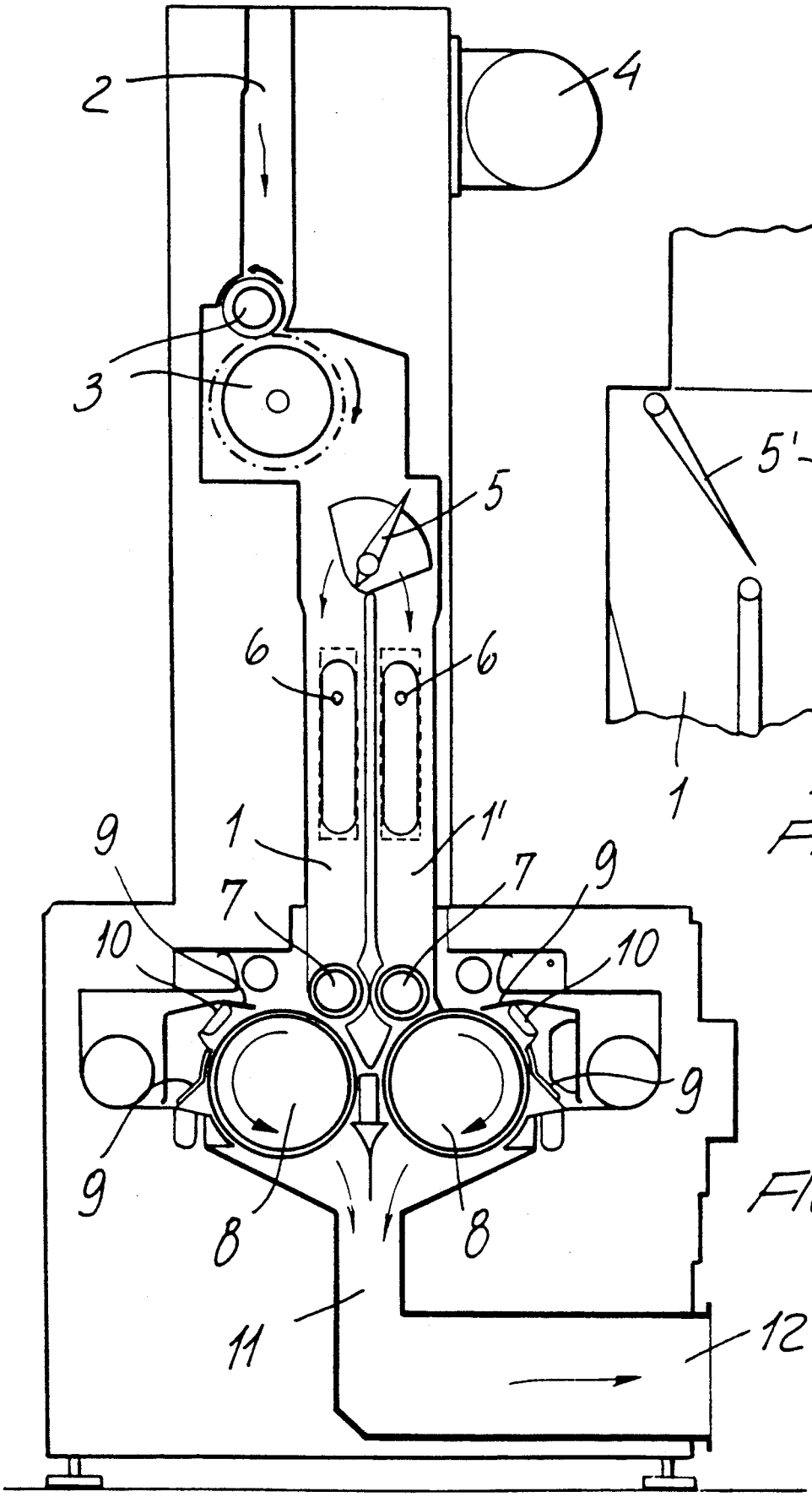
FIG. 1 is a schematic vertical cross-section of the apparatus according to the invention.
Figure 2:
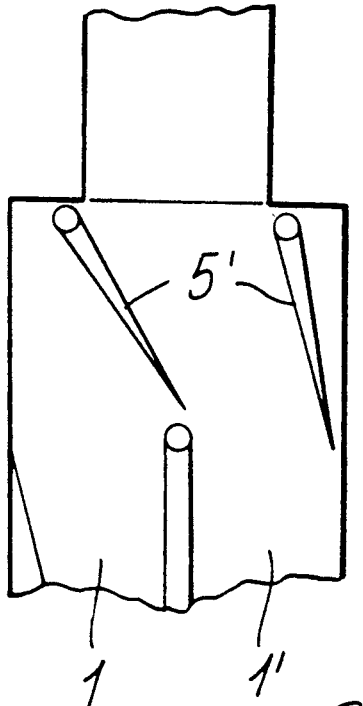
FIG. 2 shows a possible modified embodiment of the device for conveying staple cotton material to either one or the other of two cotton supply chambers included in the subject apparatus and supplying with staple cotton underlaying staple cotton gripping and opening cylinders.

More specifically, the staple cotton material, depending on the mutual positions of the baffle 5 or baffle pair 5', as is shown in FIG. 2, will start to fill with cotton one of the mentioned chambers.

As the cotton being supplied arrives at the level of a sensor 6, for example a photocell, an actuator device will cause the baffle or baffle pair to rotate so as to discharge the staple cotton into the other chamber.

This chamber should also comprise a suitable sensor adapted for driving the mentioned actuator device to cause said baffles to return to their starting position.

As is shown, at the bottom of each said chamber there is provided a cotton gripping cylinder or roller 7, rotating about an horizontal axis, therewith a rotary cotton opening cylinder 8 cooperates.

Adjoining the opening cylinder there are arranged suitable cleaning devices, for example cleaning or removing blades 9 provided for removing not spinnable cotton fibres includes in the cotton staples to discharge these fibres through a grid (which has not been shown.

Near the mentioned opening cylinder and upstream of the cleaning blade 9 there is moreover arranged a stationary plate 10 thereagainst the cylinder 8 supplies cotton staples to be processed, this carding plate operating for further opening the cotton staples and arrange the cotton fibres parallel to one another.

In this connection it should be pointed out that the carding plate 10 cooperates with the cylinder 8 to cause carding action on the cotton entrained by the cylinder 8: the cleaning blade 9, on the other hand, is arranged near the periphery of the cylinder 8 and forms with the surface of the cylinder a gap through which the cotton pre-processed by the carding plate 10 is caused to pass. Not spinnable material, such as rock and debris pieces, will be held by the blade 9 and discharged through the gap defined with the wall of the apparatus housing. These not spinnable materials have generally a size larger than that of the mentioned gap defined by the blade.

Of course, it should be apparent that the opening cylinder can also be replaced by a cleaning reel and related grid.

Downstream of the mentioned opening cylinder there is arranged a vertical manifold 11 communicating with a vacuum duct 12 for conveying the staple cotton material outside of the apparatus.

Thus, the provision of two supply separated chambers each of which is supplied by a cooperating pair of opening cylinders, will provide the subject apparatus with a great operation speed capability.

Moreover it will be possible to use cylinder gaskets or linings much thinner than those used in conventional apparatus, thereby the cotton fibres will be smoothly processed and they will be not subjected to any pulling or stretching stresses.

Moreover the processed cotton material will be very homogeneous, since it will be supplied from two different opening zones.

While the invention has been disclosed and illustrated with reference to a preferred embodiment thereof, it should be apparent that the disclosed embodiment is susceptible to several modifications and variations, all of which will come within the spirit and scope of the accompanying claims.

We claim:

1. An apparatus for opening and mixing staple cotton comprising two vertical axis staple cotton adjoining chambers, each said chamber having an open top and an open bottom and being supplied with staple cotton to be processed through the top thereof, a staple cotton gripping rotary cylinder arranged at said bottom of each said chamber and a staple cotton entraining and opening rotary cylinder arranged near said gripping rotary cylinder, each said cotton opening cylinder communicating with a vertical manifold in turn communicating with a vacuum duct for discharging processed staple cotton from said apparatus, near each said cotton opening cylinders there being moreover provided a carding plate for carding said staple cotton entrained by each said opening rotary cylinder and downstream of said carding plate, a cleaning blade adapted to remove not spinnable material included in said staple cotton.

2. An apparatus according to claim 1, wherein said apparatus further comprises a swinging baffle for alternatively supplying with staple cotton either one or the other of said chambers, said baffle being controlled by a staple cotton sensor associated with each said chamber for detecting a set level of said staple cotton in each said chamber.

* * * * *